United States Patent [19]

Lanciaux

[11] Patent Number: 4,621,438

[45] Date of Patent: Nov. 11, 1986

[54] ENERGY EFFICIENT CLOTHES DRYER

[75] Inventor: Francis Lanciaux, Fort Wayne, Ind.

[73] Assignee: Donald M. Thompson, Glen Ellyn, Ill. ; a part interest

[21] Appl. No.: 457,528

[22] Filed: Jan. 13, 1983

Related U.S. Application Data

[63] Continuation-in-part of Ser. No. 212,804, Dec. 4, 1980, abandoned.

[51] Int. Cl.[4] ..... F26B 21/06

[52] U.S. Cl. ..... 34/77; 34/133; 34/242; 62/158; 62/228.1

[58] Field of Search ..... 34/77, 89, 133, 242; 62/158, 228; 417/225, 32

[56] References Cited

U.S. PATENT DOCUMENTS

| | | | |
|---|---|---|---|
| 1,119,011 | 12/1914 | Grosvenor | 34/77 |
| 2,172,059 | 9/1939 | Chilton | 34/77 |
| 2,676,418 | 4/1954 | Shewmon | 34/77 |
| 3,190,011 | 6/1965 | Shields | 34/133 |
| 3,263,335 | 8/1966 | Kan | 34/77 |
| 3,718,982 | 3/1973 | Deaton | 34/82 |
| 3,786,649 | 1/1974 | Kirschner | 62/394 |
| 3,877,837 | 4/1975 | Parker et al. | 417/25 |
| 3,978,592 | 9/1976 | Schuurink | 34/82 |
| 4,007,546 | 2/1977 | Sauer | 34/133 |
| 4,142,375 | 3/1979 | Abe et al. | 62/158 |

*Primary Examiner*—Larry I. Schwartz

*Attorney, Agent, or Firm*—Edward W. Osann, Jr.

[57] ABSTRACT

An energy efficient heat pump dryer for clothes and other washables having a sealed rotatable clothes tumbling drum and means for circulating a stream of heated drying air in a substantially closed path through the tumbling drum. The drum is journaled upon a combined bearing and air seal means at each end. A heat pump is incorporated as the source of heat for the drying air, as a means for recirculating heat from the drying air exhausted from the tumbling drum, and as a means for removing entrained moisture from the exhausted drying air. The dryer is adapted to operate from a 110 volt household power supply and requires no air vent to the outside.

20 Claims, 26 Drawing Figures

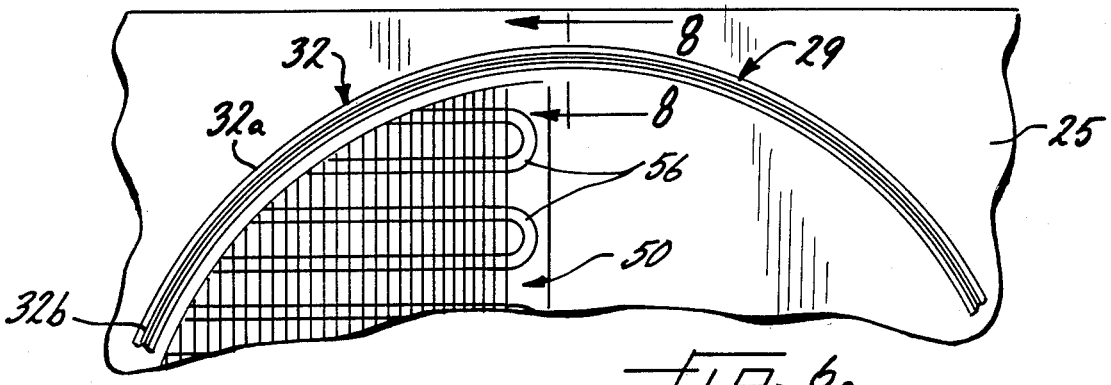
Fig. 6.
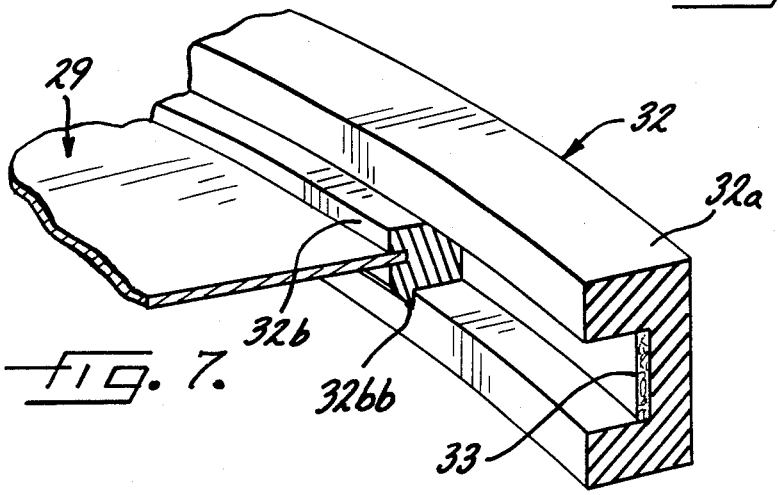
Fig. 7.
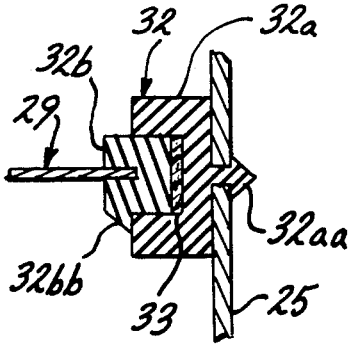
Fig. 8.
Fig. 9.
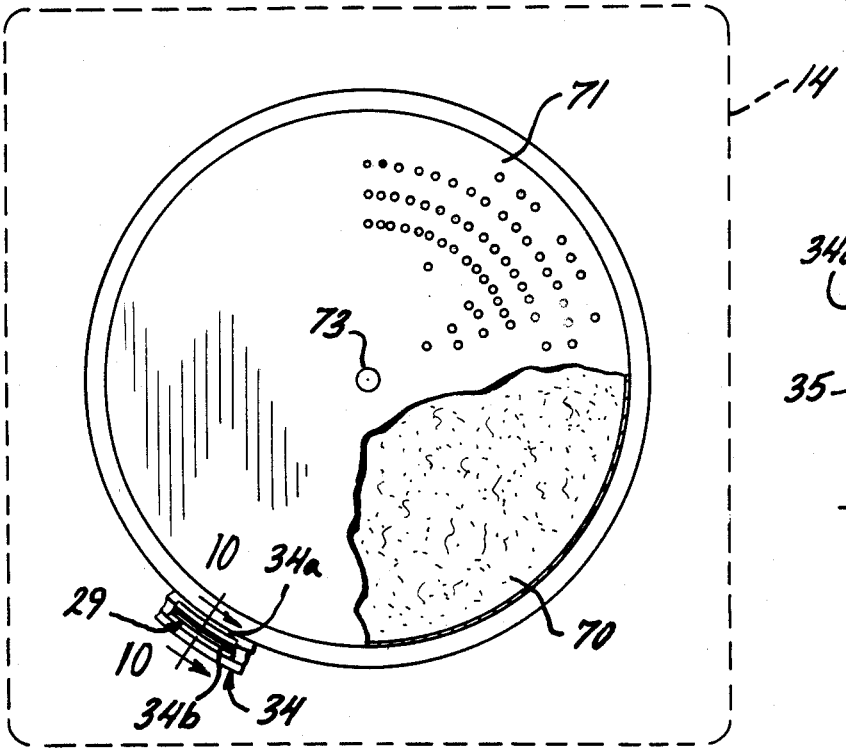
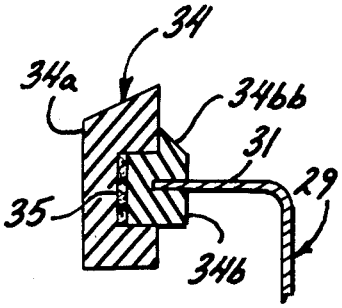
Fig. 10.

FIG. 15.
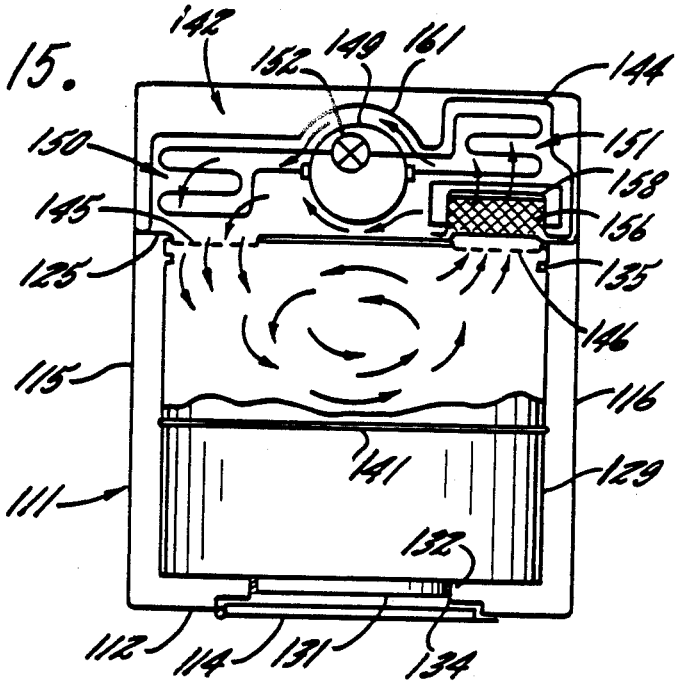
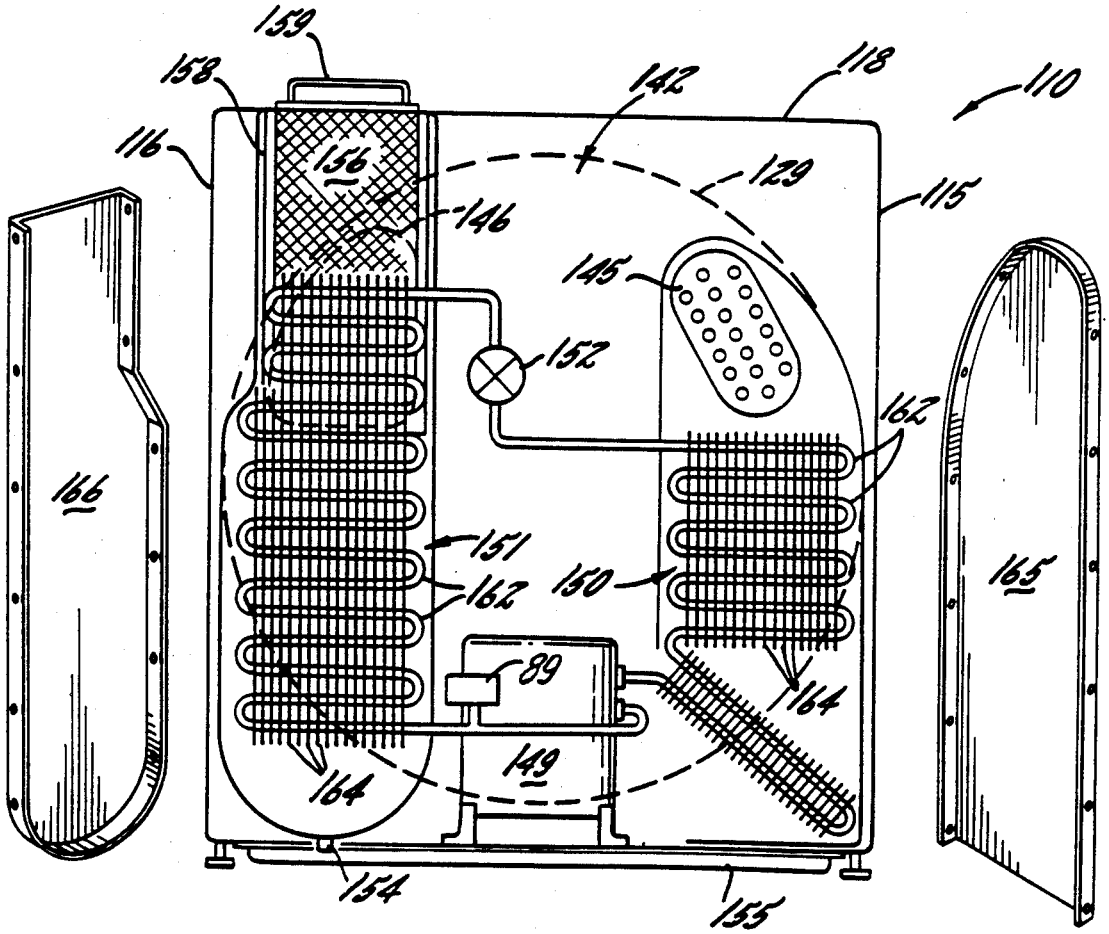
FIG 16.

ENERGY EFFICIENT CLOTHES DRYER

This application is a continuation-in-part of my copending U.S. patent application Ser. No. 212,804, filed Dec. 4, 1980 and now abandoned.

BACKGROUND OF THE INVENTION

The present invention relates in general to dryer appliances for clothes and other washable products. It finds particular, but not exclusive, utility in an energy efficient clothes dryer of the type utilizing a rotatable tumbling drum and heat pump for circulating a flow of heated air through the drum.

National energy policy in the United States now calls for gradually phasing out conventional electrical appliances which are energy inefficient in favor of appliances which are energy efficient. The urgency underlying this policy is readily apparent, since about 75 percent of the energy consumed in an ordinary household is used by various electrical appliances including clothes dryers. Appliance buyers are now learning to look for energy efficiency, as well as price, in making their appliance selections.

Conventional electric resistor heated clothes dryers, widely used in homes and laundromats, do an acceptable job of drying but are not energy efficient. Such dryers operate with high power consumption which typically may be on the order of 4000 to 5500 watts. They normally require a 220 volt power supply which often must be specially installed at considerable expense. They also require installation of an air vent duct to the outside, resulting in further expense.

As an alternative, and also as a supplement, to an electrical resistor heat source, it has been known heretofore to use waste heat from a heat pump condenser in a clothes dryer or other drying apparatus. These prior arrangements are for the most part complex in structure and operation, or cumbersome, or crude, and are not well suited for efficient layout within the confines of a household clothes dryer cabinet.

SUMMARY OF THE INVENTION

The general aim of the present invention is to provide an improved dryer appliance for clothing and other washable products which will be energy efficient in operation as compared to dryers of the electrical resistor heated type heretofore known.

A more specific object of the invention is to provide a clothes dryer of the foregoing type having a clothes tumbling drum journaled within a cabinet upon a combined bearing and air seal means, and utilizing a heat pump system as a source of heat for the drying air circulated through the tumbling drum.

A further object of the invention is to provide an energy efficient clothes dryer of the above character utilizing a heat pump condenser as a source of heat for the drying air and having means for positively circulating and recirculating heated drying air in a closed path through the tumbling drum, and for recirculating a substantial portion of the residual heat contained in the air upon being exhausted from the tumbling drum while removing entrained moisture from the exhausted air.

Another object is to provide a clothes dryer of the above noted type wherein the maximum temperature of the drying air will be determined by metering the flow of refrigerant in the system and by metering the flow of air across the condenser, thereby eliminating the need for air temperature control thermostats.

A further object is to provide a clothes dryer of the foregoing type capable of operating efficiently from a 110 volt household power supply.

Another object of the invention is to provide a clothes dryer of the character set forth above wherein the drying air is heated, circulated through the drum, and recirculated in a closed circuit without necessity for an external air vent.

Still another object is to provide a clothes dryer of the above type capable of being incorporated within a cubic volume approximately the size of a conventional electric resistance type clothes dryer cabinet and enabling the dryer to be mounted with the back of said cabinet flush against the wall.

Other objects and advantages will become apparent as the following detailed description proceeds, taken in conjunction with the accompanying drawings.

BRIEF DESCRIPTION OF THE DRAWINGS

FIG. 6 is an enlarged fragmentary front elevational view of the transverse separator panel of the clothes dryer illustrating a portion of the rear drum support bearing and seal means.

FIG. 7 is a further enlarged fragmentary perspective view detailing a representative portion of the rear drum support bearing and seal means.

FIG. 8 is an enlarged transverse sectional view taken through the rear bearing and seal means in the plane of the line 8—8 in FIG. 6.

FIG. 9 is an enlarged, fragmentary elevational view of the inside face of the front wall of the dryer cabinet taken in the plane of the line 9—9 in FIG. 3 illustrating a portion of the front drum support bearing and seal means.

FIG. 10 is a further enlarged transverse sectional view taken in the plane of the line 10—10 in FIG. 9.

FIG. 15 is a horizontal sectional view taken through the upper portion of the dryer in the plane of the line 15—15 in FIG. 13.

FIG. 16 is an enlarged rear elevational view of the illustrative dryer of FIG. 12 illustrating in further detail the condenser and evaporator structures utilized therein, the access covers having been removed for purposes of clearer illustration.

Figures 1, 3A, 4A:
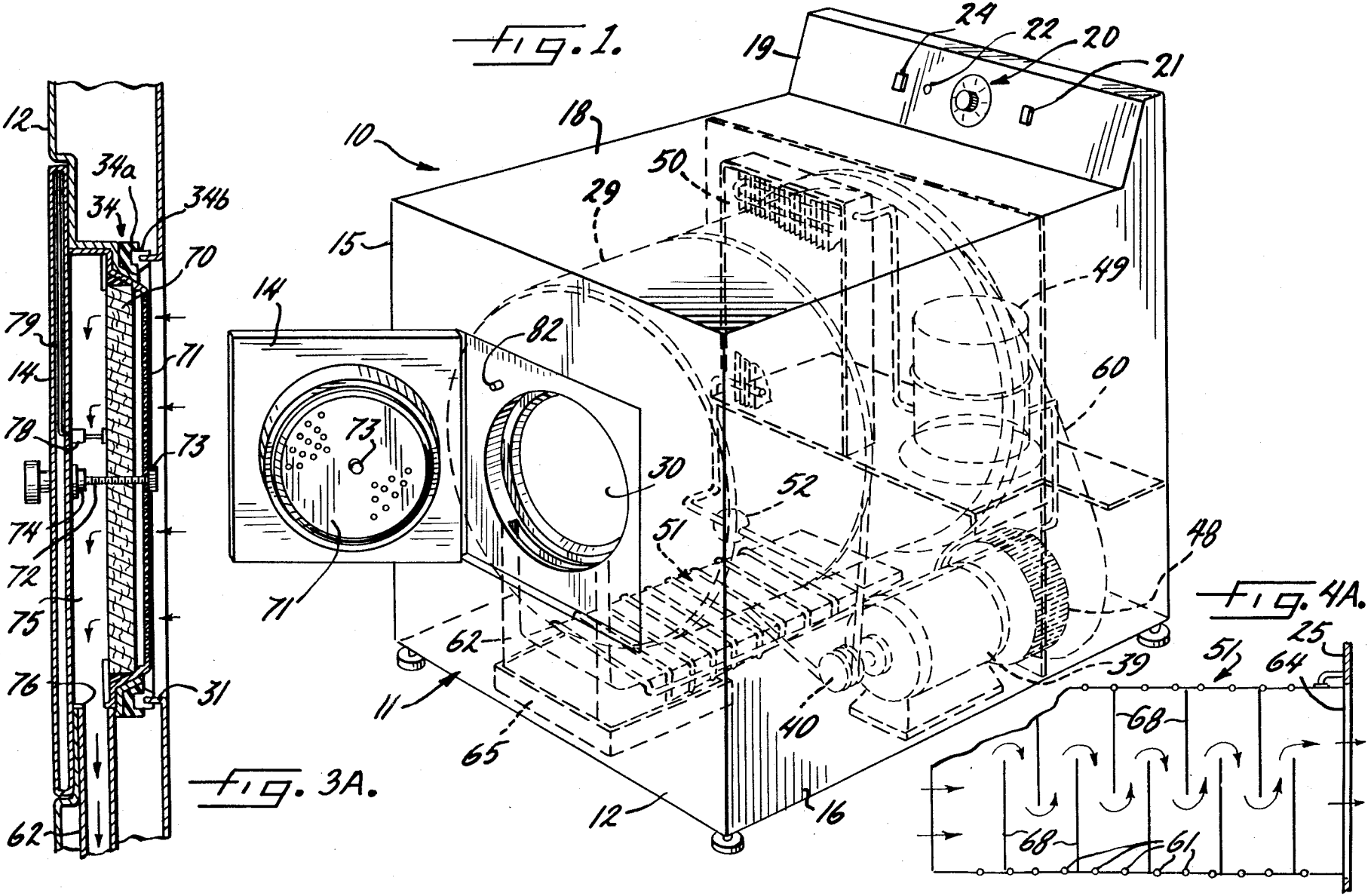
FIG. 1 is a front perspective view of one illustrative clothes dryer embodying the present invention, the drum being shown in dot-dash outline for purposes of clearer illustration of the remaining structure.
FIG. 3A is an enlarged, fragmentary vertical sectional view taken through the door and adjacent portions of the drum and cabinet in the plane of the line 3—3 in FIG. 2.
FIG. 4A is a horizontal sectional view through the evaporator taken in the plane of the line 4A—4A in FIG. 3.
Figure 2:
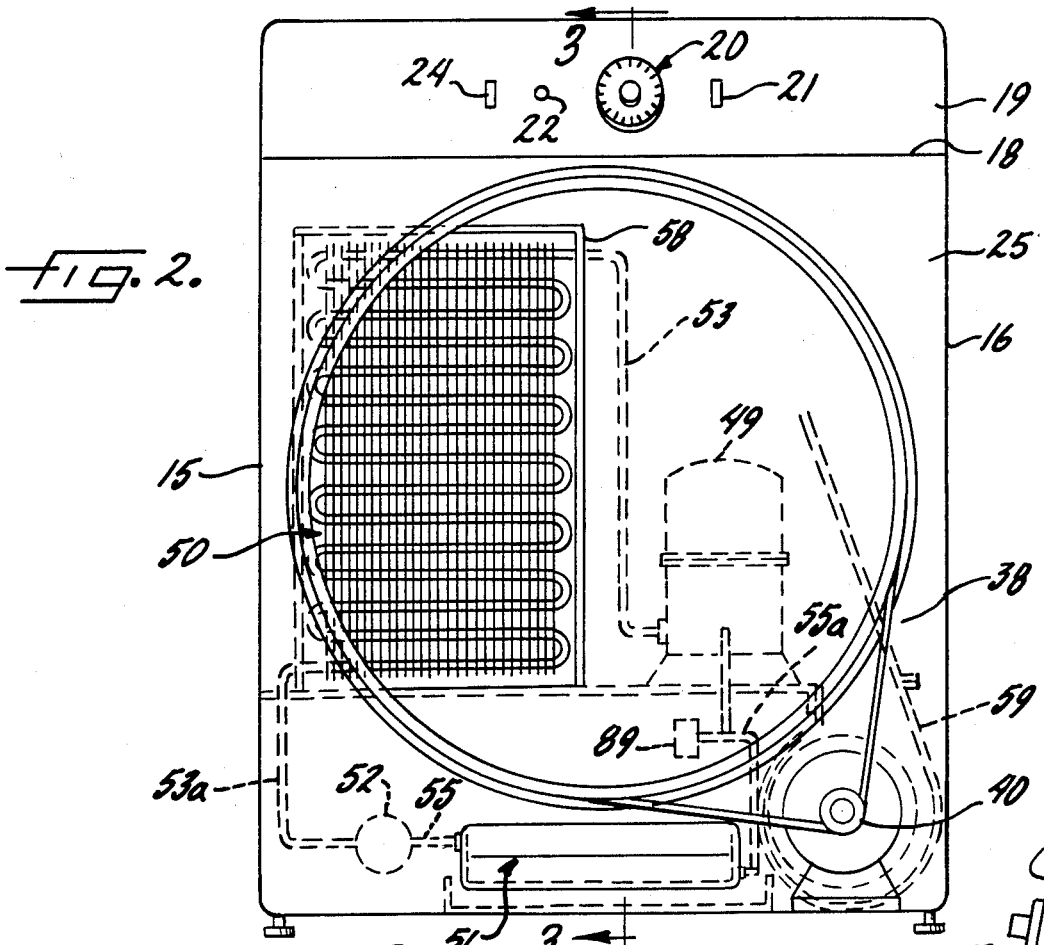
FIG. 2 is a transverse vertical sectional view taken through the illustrative clothes dryer of FIG. 1 in the plane of the line 2—2 in FIG. 3.

While the invention is susceptible of various modifications and alternative constructions, certain illustrative embodiments have been shown in the drawings and will be described below in considerable detail. It should be understood, however, that there is no intention to limit the invention to the specific forms described, but, on the contrary, the intention is to cover all modifications, alternative constructions, and equivalents falling within the scope of the appended claims.

DETAILED DESCRIPTION

Referring more specifically to FIGS. 1–10, the invention is there exemplified in an illustrative clothes dryer 10. The latter comprises a cabinet 11 having a front panel 12 with an access door 14, a pair of side panels 15, 16, a back panel 17, a flat top panel 18, and an upstanding control panel 19 at the rear of the top panel. The control panel has an adjustable timer 20 at its center, and on-off switch 21 to the right of the timer, and a trouble light 22 and reset button 24 to the left of the timer.

The interior of the dryer cabinet 11 has a transverse partition 25 extending between the side panels 15, 16 from top to bottom. The partition 25 divides the interior space into a relatively deep drum compartment 26 and a relatively shallow auxiliary compartment 28. A generally cylindrical tumbling drum 29 is rotatably mounted between the front panel 12 and the transverse partition 25. The front end portion of the drum 29 has an annular front wall defining an access opening 30 which registers with the circular projecting closure of the door. The opening 30 is surrounded by an out-turned flange 31 which engages front support means for the drum. The rear end portion of the drum 29 has the full diameter of the drum and engages the rear support means for the drum.

Means are provided for rotatably supporting the drum 29 in the drum compartment 26 on a precisely centered rotational axis and, as an incident to such support, sealing both ends of the drum against air leakage. This is accomplished in the present instance by the use of a combined bearing and air seal at each end of the drum. Referring more specifically to FIGS. 3, 3A, 4 and 6–10, it will be noted that the rear end portion of the drum 26 is journaled in a combined bearing and air seal 32. The latter comprises a fixed annular track 32*a* of generally U-shaped cross section and an annular slider 32*b* interfitting closely with the rectangular central groove in the track. The members 32*a*, 32*b* may conveniently be fabricated from low friction non-metallic material such as NYLON plastic. The track 32*a* may be fixed to the partition 25 as by means of integral rivets 32*aa* or other suitable fastening means, including adhesive. The slider 32*b* is appropriately slotted to receive the marginal rear end portion of the drum 29 and may be secured thereto in any suitable manner.

For the purpose of enhancing the air seal between the track and the slider, an annular gasket 33 of resilient material such as felt may be interposed in the track groove between the track 32*a* and slider 32*b*. In addition, the edge of the slider inside the drum may be formed with an overlapping bead 32*bb* bearing against the opposed end of the track (FIGS. 7, 8).

Turning next to FIGS. 3, 3A, 4, 9 and 10, the front end portion of the drum 29 is journaled on a combined bearing and air seal 34 similar in construction to the member 32 but substantially smaller in diameter. The member 34 comprises a fixed annular track 34*a* of generally U-shaped cross section having an angular peripheral wall adapted to nest against the tapered flange of the front wall panel 12 opposite the drum access opening 30. The fixed track 34*a* may be secured to the wall of the panel 12 in any suitable manner, including mechanical or adhesive means. Cooperating with the track 34*a* is an annular slider 34*b* similar in cross section to the slider 32*b* described above. The slider 34*b* is slotted to receive the out-turned flange 31 at the front end of the drum 29 and may be secured thereto in any suitable manner. To enhance the seal, the inner edge of the slider 34*b* is provided with an angular bead 34*bb* which bears against the inner end of one arm of the track. An annular gasket 35 of felt or similar material may also be interposed between the groove of the track and the inner face of the slider 34*b*.

For the purpose of rotatably driving the drum 29, the medial portion of the latter may be formed with a peripheral groove 36 engaged by a drive belt 38. The belt, in turn, is driven by motor 39 and drive pulley 40 located in the drum compartment (FIGS. 1–4).

Provision is made for positively circulating a stream of heated drying air in a closed path through the tumbling drum 29 and for recirculating a substantial portion of the residual heat contained in the air upon being exhausted from the tumbling drum while removing entrained moisture from the exhausted air (FIGS. 1–5). This is accomplished in the present instance by mounting a heat pump system 42 in the dryer cabinet 11 enclosed within air duct means 44. The latter is connected between the large segmental air inlet 45 in the partition 25 at the rear of the drum and the large circular access opening 30 which serves as the moist air outlet at the front of the drum. A blower 48, driven by the motor 39, is adapted to maintain positive circulation of the heated airstream through the closed path which includes the tumbling drum.

The heat pump system 42 comprises a compressor 49, a condenser 50, an evaporator 51, and refrigerant expansion regulator means exemplified by thermostatic expansion valve 52 or a suitable capillary tube. The system 42 is adapted to use an appropriate refrigerant such as Freon R-12, R-11 or R-22. The system 42 operates satisfactorily with its major components, namely the compressor, condenser, expansion valve and evaporator, each rated on the order of 12,000 BTU per hour.

High pressure refrigerant line 53 connects the compressor with the condenser 50 and high pressure line 53*a* connects the condenser with the expansion valve 52. Low pressure line 55 connects the expansion valve 52 with the evaporator 51 and return line 55*a* connects the latter with the suction side of the compressor.

In accordance with the present invention, the heat pump system 42 is incorporated into the dryer cabinet 11 in a highly efficient manner which minimizes total cubic size and permits the cabinet to be situated with its back flush against the wall. This is accomplished in part by mounting the compressor 49, condenser 50, and blower 48 in the auxiliary compartment 28 enclosed by air duct means 44 which communicates with the drum through air inlet 45 in the transverse partition. It is also accomplished in part by mounting the evaporator 51 in the drum compartment 26 below the drum, and utilizing the evaporator, the front wall, and the access door 14 as part of the air duct means to convey and dehumidify the warm moist air exhausted from the drum while sending it back to the blower 48.

Referring again to FIGS. 1–5, it will be noted that the compressor 49 is mounted on a horizontal platform 54 which extends for the full width and depth of the auxiliary compartment 28 except for a clearance recess which accommodates the blower discharge. The condenser 50, which in this instance is constructed as a heat exchanger formed by nested coils 56 of copper or aluminium tubing extending through a stack of spaced apart metallic plates or fins 57, is supported in a generally rectangular housing 58 which rests upon the platform 54. The housing 58 is secured to the rear face of the partition 25 with the bulk of the area of the condenser in register with the large segmental air inlet 45 for the drum 29. The air discharge connection 43 of blower 48 is connected to the condenser housing 58 by the air duct means 44. The latter is defined by an arcuate duct panel 46 connected between the blower discharge and the upper portion of the condenser housing 58, a side duct panel 47 running between the arcuate panel 46 and the platform 54, and an end duct panel 47*a* which connects the righthand end of the condenser housing (as viewed in FIGS. 4 and 5) to the side duct panel 47.

Referring more particularly to FIGS. 1–4, it will be noted that the evaporator 51 is fashioned as a hollow duct or tunnel of generally rectangular cross-section. The evaporator in this case is fabricated of embossed metal plates known as "rollbon". These embossed plates define a series of convoluted channels 61 extending around the inner and outer periphery of the duct and are adapted to carry expanded gaseous refrigerant.

The evaporator 51 is situated with its forward end communicating with an air duct 62 extending downwardly from the door opening inside the front panel 12 of the cabinet, and its rearward end in register with a generally rectangular opening 64 communicating with the auxiliary compartment below the platform 54. The bottom wall of the evaporator inclines downwardly toward the front of the cabinet and serves to discharge condensed moisture into a collecting sump 65 from which it may be pumped to a sink or discharged to a floor drain.

Figure 3:
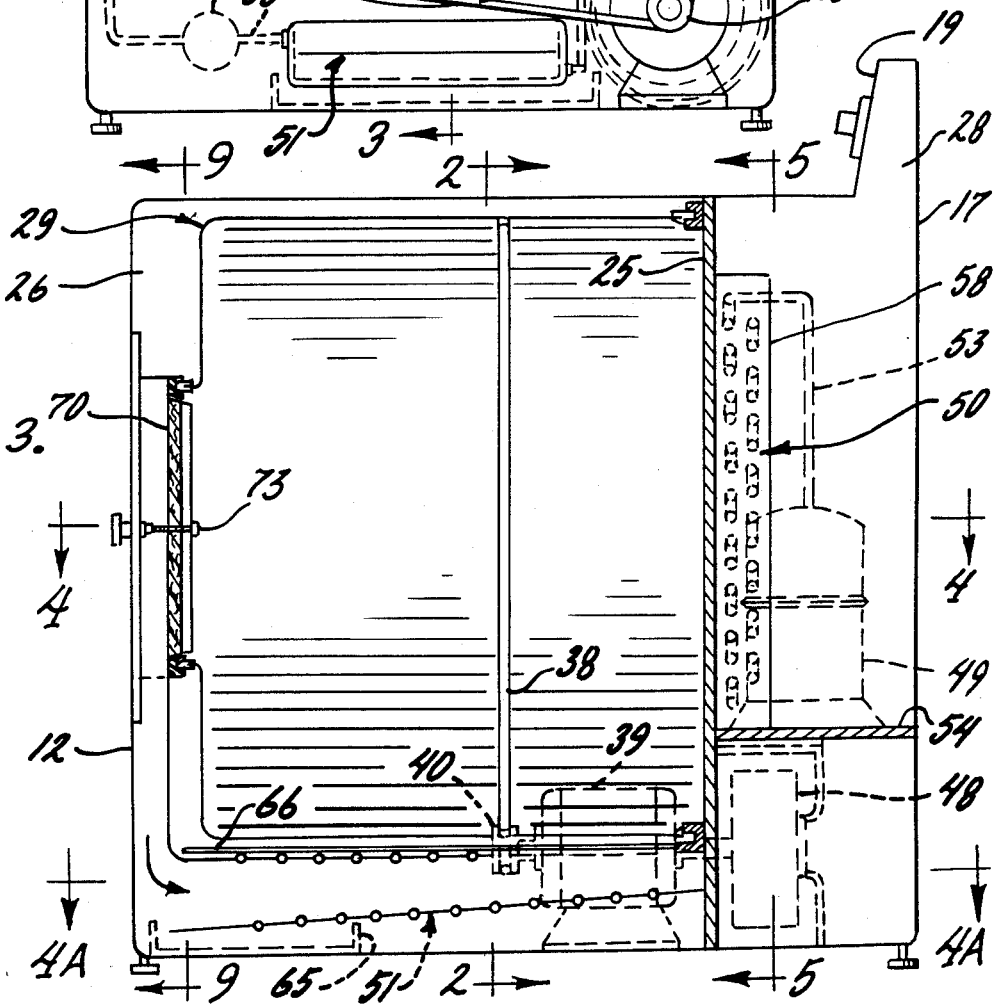
FIG. 3 is a vertical sectional view taken axially of the clothes drum in the plane of the line 3—3 in FIG. 2.
Figure 4:
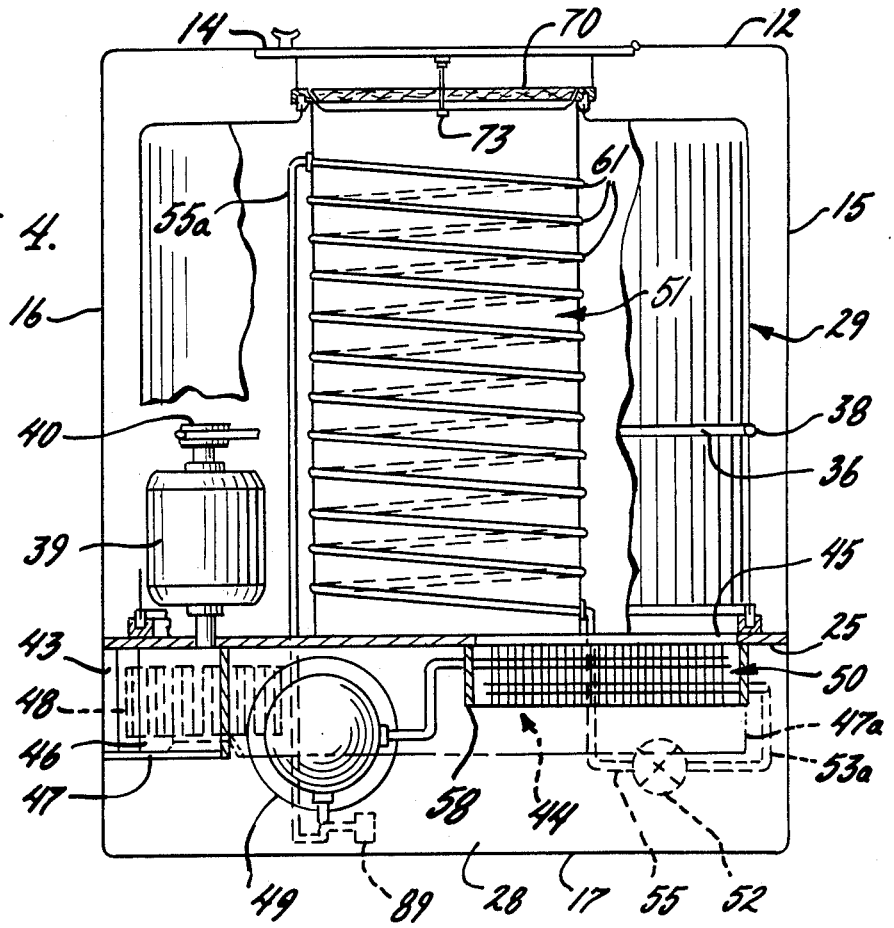
FIG. 4 is a horizontal sectional view through the dryer taken axially of the drum in the plane of the line 4—4 in FIG. 3.
Figure 5:
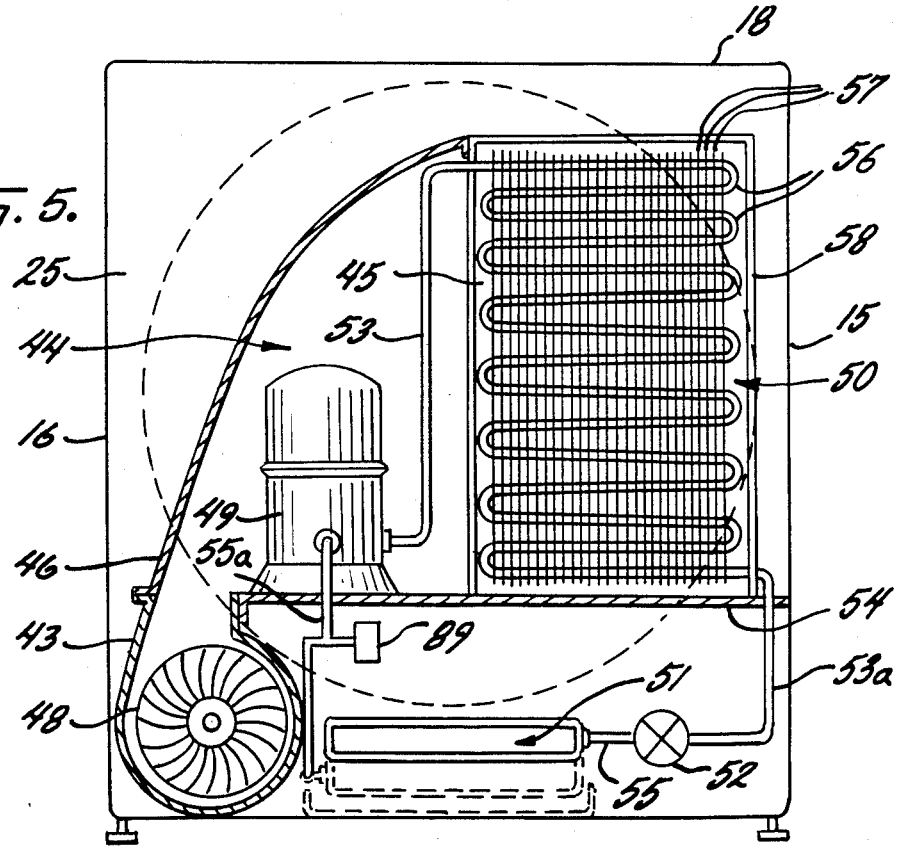
FIG. 5 is a vertical sectional view through the dryer in the plane of the line 5—5 in FIG. 3.

The top wall of the evaporator may be protected against heat radiated from the tumbling drum by the use of an overlying panel of thermal insulation 66 such as rock wool, shown schematically in FIG. 3. To facilitate condensation of the entrained moisture in the air passing through the evaporator, the latter may also be equipped with a series of internal baffles 68 as shown schematically in FIG. 4A. The baffles are provided with small openings along their bottom edges to permit water condensate to travel down the bottom wall to the sump 65.

In order to protect the heat pump system 42, and particularly the evaporator and condensor, against a build-up of lint in the course of operation of the dryer, a lint screen 70 is nested into the access door 14. The screen is protected on the drum side by means of a perforated metal plate 71 and is retained in place in the door as by means of a screw 72 with a knurled head 73. The screw 72 is adapted to engage a small hub 74 fixed to the back of the door panel. The door is constructed with a large passage 75 on the downstream side of the lint screen 70 to carry the air exhausted from the drum. The circular rim of the door has an arcuate opening 76 which connects the air passage 75 in the door with the downwardly extending duct 62 inside the front panel. A suitable clog sensing device 78 may be provided in the door 14 to initiate a signal in the event that the screen 70 should become clogged with an accumulation of lint. The sensing device 78 is adapted to generate a signal in response to outward deflection of the clogged lint screen under the air pressure within the drum 29. The device 78 then sends the signal via lead 79 to energize control relay RL, thereby opening relay contacts RL-1 and tripping off power to the dryer (FIG. 11).

In operation of the dryer 10, the refrigerant flow may be metered so as to stabilize a condenser coil temperature of about 155 degrees F. and a pressure of about 250 psi on the high side of the expansion valve 52. By metering the air flow across the condenser coils, as well as the refrigerant flow, the maximum temperature of the drying air may be stabilized at approximately 145 degrees F., eliminating the need for air temperature regulating thermostats.

Figure 11:
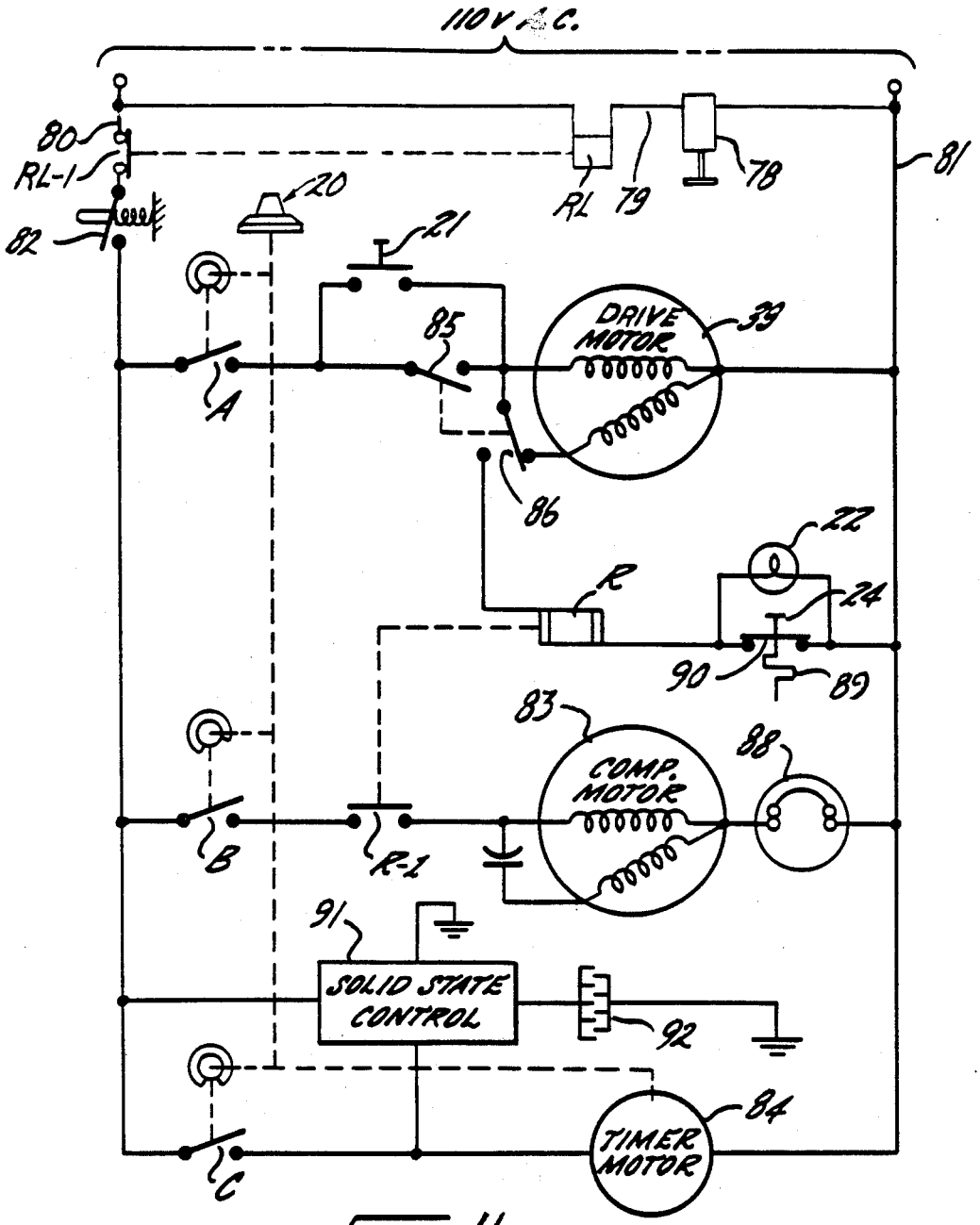
FIG. 11 is a schematic wiring diagram illustrating the electrical circuitry associated with the dryers of FIGS. 1, 12 and 17.

Turning now to FIG. 11, an exemplary electrical circuit is there shown which is adapted to operate the dryer 10 from conventional 110 volt AC household power via supply line conductors 80, 81. The actual voltage of any such supply may be on the order of 110 to 115 volts, depending upon a number of outside factors. The circuit includes the usual door switch 82 which cuts off all power when the access door 14 is opened. The circuit also includes drum and blower drive motor 39 and compressor motor 83, both controlled by the timer 20. The latter comprises timer motor 84 and manually preset switches A, B and C operated by the motor 84 through appropriate mechanical connections.

The drive motor circuit includes timer swtich A, push-button start switch 21, a single-pole running switch 85, and a double-pole starting switch 86, the switches 85 and 86 being centrifugally actuated by the drive motor. Assuming that the timer switch A is closed, the drive motor may be started by depressing push-button switch 21, thus completing a circuit from supply line 80 through timer switch A, switch 21, starting switch 86 which is in the right hand position shown in FIG. 11, starting winding of drive motor 39, to supply line 81. After the drive motor has reached normal operating speed, the centrifugally actuated double-pole switch 86 shifts to its second or left hand position, opening the starting circuit and closing the circuit of time delay relay R as the running switch 85 is centrifugally actuated to close. The drive motor thus continues to run until either the timer switch A, or the door switch 82, is opened.

The compressor motor 83, of the capacitor type, is connected across the supply circuit 80, 81 through timer switch B, relay contacts R-1, and thermal overload switch 88. Contacts R-1 are actuated by time delay relay R (FIG. 11). The relay R pauses for three minutes, following closure of centrifugal running switch 85 and closure of centrifugal starting switch 86 in its left hand postion, before becoming energized and closing contacts R-1. This relay protects the longevity of the compressor by allowing time for the head pressure to equalize, thereby creating easy starting conditions. The above arrangement is such that the compressor motor normally will run as long as the timer switch B is closed. The overload switch 88 is of the bimetallic type and opens when the compressor motor overheats beyond a given set point or when current draw becomes excessive. The switch 88 is adapated to reclose itself upon cooling below its set point.

The circuit further includes protection for the compressor 49 in the event that a condition called "frostback" should occur. This happens when the temperature on the low pressure side of the expansion valve 52 drops below approximately −5 degrees F., causing the formation of liquid refrigerant in the evaporator and which is then drawn into the suction side of the compressor. Upon entering the compressor, the cold liquid refrigerant mixes with the hot lubricating oil inside and creates an oil foam. As the compressor continues to operate, more and more oil foam is generated and discharged into the refrigeration system. After a relatively short time, the lubricating oil supply in the compressor becomes exhausted, inflicting severe damage upon the compressor and rendering it inoperable. Frostback may, for example, occur due to factors such as plugging of the lint screen 70, thereby restricting the air flow over the evaporator 51. It may also occur due to other conditions such as a defective drum seal, defective door seal, lint accumulation in various air passages, or a leak in refrigerant tubing.

In order to prevent damage to the compressor from frostback, safety thermostat 89 is utilized to sense the temperature of the refrigerant on the low pressure side of the expansion valve. In the present instance, the safety thermostat 89 is interposed in the return line **55*a* so as to sense the temperature of the refigerant leaving the evaporator. The thermostat 89 is set to cut off power to the compressor motor 83** when the temperature of the refrigerant leaving the evaporator drops below −5 degrees F.

When the safety thermostat 89 is actuated due to a temperature drop below −5 degrees F., its contacts 90 open and the trouble light 22 becomes energized to apprise the user of that condition. In addition, power to relay R is interrupted causing relay contacts R-1 to open, thus de-energizing the compressor motor 83 and stopping the compressor until the emergency condition has been remedied. The safety thermostat switch 89, unlike the self-resetting overload switch 88, must be manually reset by depressing the push-button 24. When the push-button 24 is depressed, the thermostat switch 89 recloses, deenergizing the trouble light 22 and applying power to the time delay relay R. After approximately three minutes, the relay R becomes energized and closes contacts R-1 to restart the compressor motor.

Figure 11A:
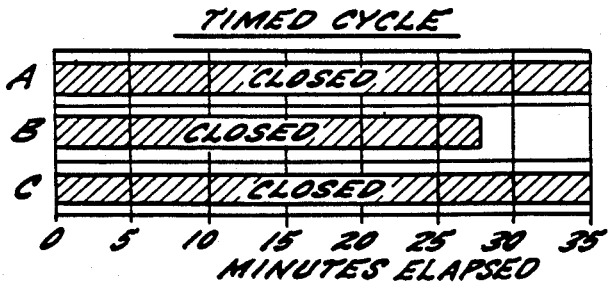
FIG. 11A is a diagram of the timer switch settings for the timed cycle of operation of the dryer.
Figure 11B:
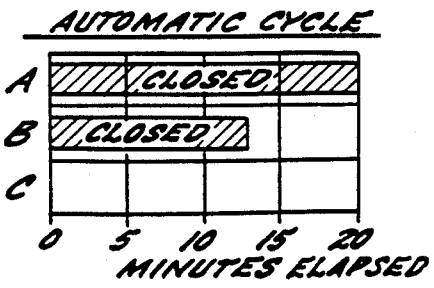
FIG. 11B is a diagram similar to FIG. 22A but illustrating the timer switch settings for the automatic cycle of the dryer.
Figure 12:
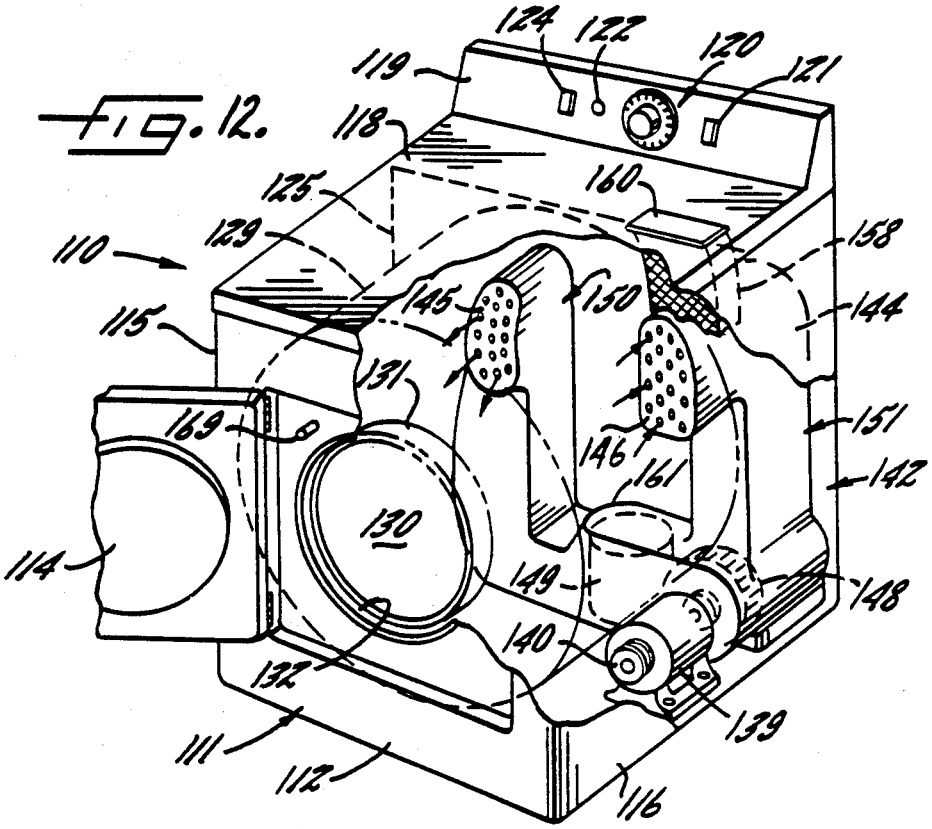
FIG. 12 is a front perspective view of another illustrative clothes dryer enbodying certain aspects of the invention.
Figure 13:
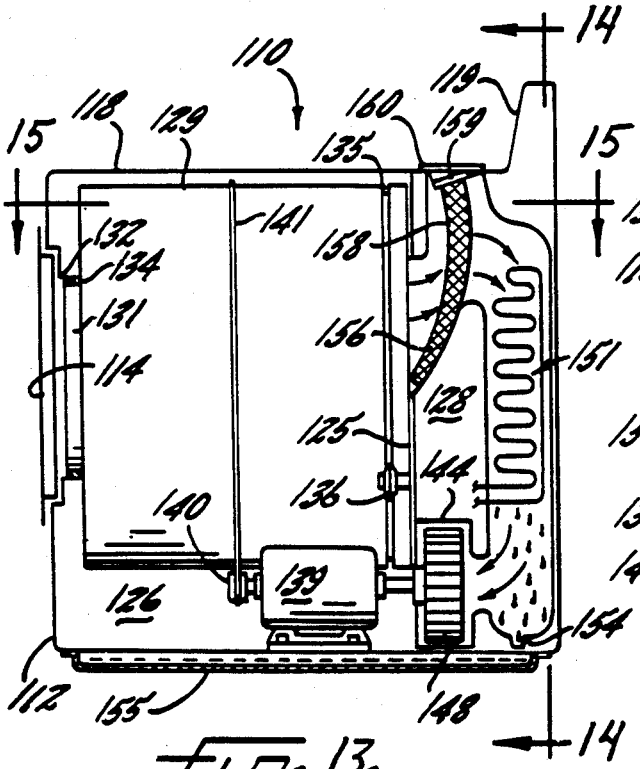
FIG. 13 is a vertical sectional view taken along the right hand side of the dryer as viewed in FIG. 12.
Figure 14:
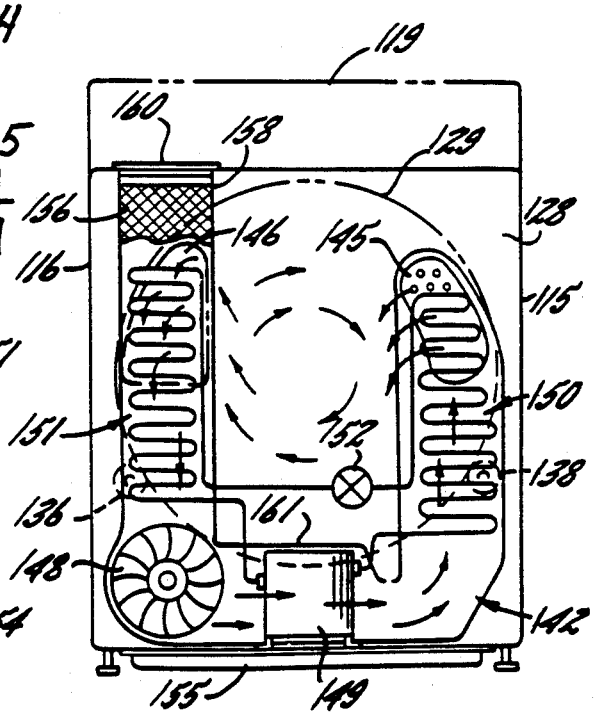
FIG. 14 is a vertical sectional view through the rear portion of the illustrative dryer, taken in the plane of the line 14—14 in FIG. 13.
Figure 17:
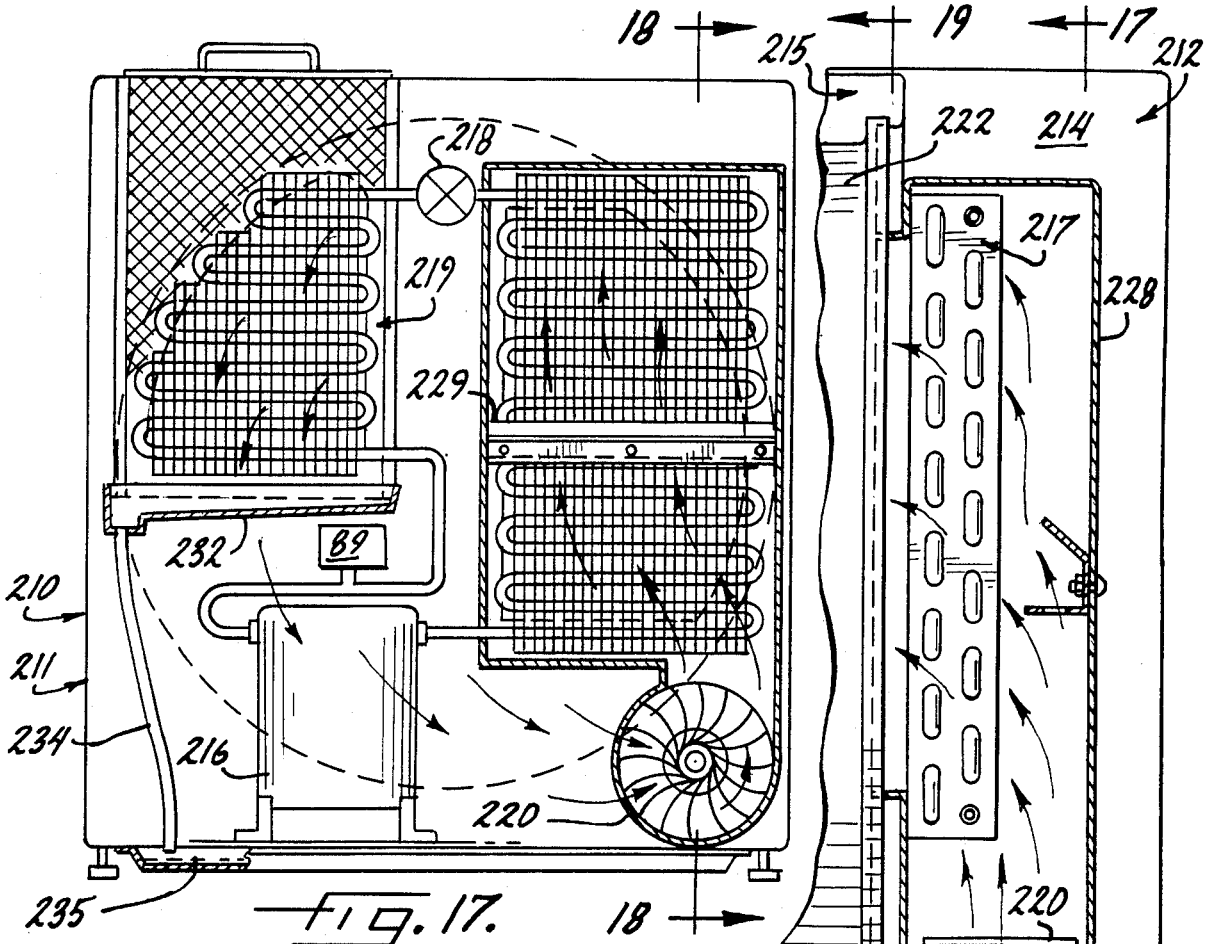
FIG. 17 is an enlarged vertical sectional view through the rearward portion of another illustrative clothes dryer embodying certain aspects of the invention, taken in the plane of the line 17—17 in FIG. 18.
Figure 18:
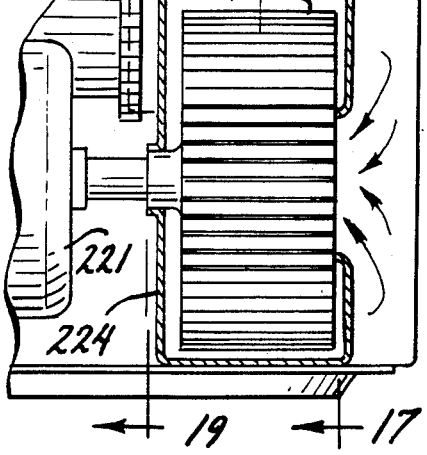
FIG. 18 is a further enlarged fragmentary vertical sectional view taken in the plane of the line 18—18 in FIG. 17.
Figure 19:
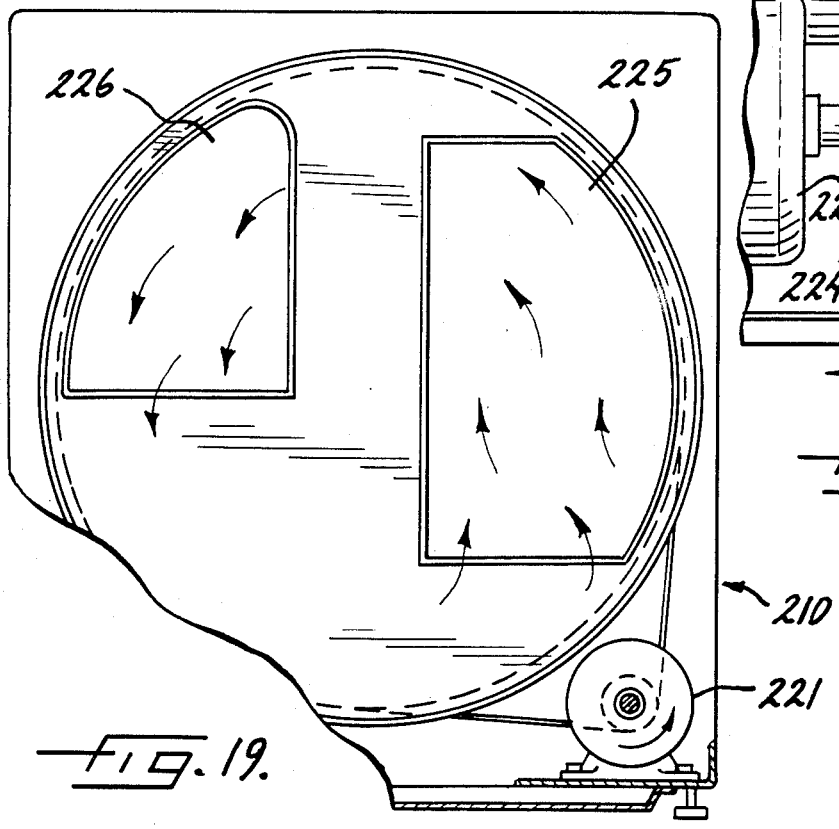
FIG. 19 is an enlarged fragmentary vertical sectional view taken in the plane of the line 19—19 in FIG. 18.
Figure 20:
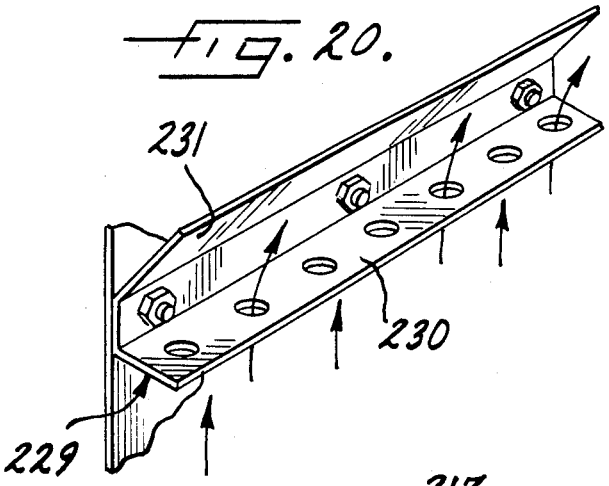
FIG. 20 is an enlarged perspective view of the air distribution baffle shown in FIGS. 17 and 18.

The circuit of FIG. 11 permits the dryer 10 to be operated in two different modes (FIGS. 11A, 11B). The first mode is the timed cycle wherein the dryer operates for a given time period up to 35 minutes and then stops. The second mode is the automatic cycle wherein the dryer operates for a variable time period with the timer motor under control of a moisture sensing circuit which stops the dryer when the clothes are dry.

In operation under the timed cycle (FIG. 11A), the timer 20 is adjusted to the desired time setting, energizing the timer motor 84 and thus closing the timer switches A, B and C. The actuating cams for switches A and C are formed to maintain those two switches in closed position for the duration of the selected time setting. This causes the drive motor 39 and the timer motor 84 to run for the duration of that time setting. The actuating cam for the timer switch B, on the other hand, is formed so as to open that switch and cut-off the compressor motor 83 during the last 5 to 10 minutes of the cycle. This makes use of the residual heat in the system and thereby saves electrical energy.

In operation under the automatic cycle (FIG. 11B), there is no set time period, the dryer simply operating until the cloths are dry. This is accomplished by operating the timer motor under a solid state control 91 and a moisture sensing device 92 in the rotating drum. In this mode, the timer switch A is closed and the drive motor 39 is energized for the full automatic cycle, whatever its duration turns out to be. The timer switch B is energized for a substantial part of the automatic cycle, cutting off about 5 to 10 minutes before the end of the cycle to save electrical energy. The switch C, which controls the timer motor 84 during the timed cycle, is declutched from the timer motor in any suitable manner (not shown) and the timer motor is then operated by the solid state control throughout the automatic cycle.

Referring next to FIGS. 12–16, another illustrative clothes dryer 110 is there shown which embodies certain aspects of the invention. The latter comprises a cabinet 111 having a front panel 112 with an access door 114, a pair of side panels 115, 116, a flat top panel 118, and an upstanding control panel 119 at the rear of the top panel. The control panel has an adjustable timer 120 at its center, an on-off switch 121 to the right of the timer, a trouble light 122 and reset button 124 to the left of the timer.

The interior of the dryer cabinet 111 has a transverse partition 125 extending between the side panels 115, 116. The partition 125 divides the interior space into a relatively deep drum compartment 126 and a relatively shallow heat pump compartment 128. A generally cylindrical tumbling drum 129 is rotatably mounted between the front panel 112 and the transverse partition 125. The forward end portion of the drum has an access opening 130 surrounded by an outturned flange 131 which is journaled within a fixed flange 132 secured to the front panel 112. A gasket 134 which may conveniently be made of felt or the like is interposed between the flanges 131, 132. The rearward end portion of the drum 129 is closed by the transverse partition 125. A peripheral groove 135 is formed adjacent such rearward end portion and engaged by a pair of tapered supporting rollers 136, 138 journaled on fixed shafts projecting horizontally from the transverse partition 125. The drum 129 is rotatably driven by motor 139 via a drive pulley 140 and belt 141, the latter extending around the medial portion of the drum.

A heat pump system 142 is provided for positively circulating a stream of heated drying air in a closed path through the tumbling drum 129 and for recirculating a substantial portion of the residual heat contained in the air upon being exhausted from the tumbling drum while removing entrained moisture from the exhausted air (FIGS. 12–16). The heat pump system 142 is mounted within the compartment 128 and enclosed within air duct means 144 connected between air inlet 145 and air outlet 146 of the tumbling drum. A blower 148, interposed in the air duct means 144 and driven by the motor 139, is adapted to maintain positive circulation of the heated air stream through the drum.

The heat pump system 142 comprises a compressor 149, a condenser 150, an evaporator 151, and a thermostatic expansion valve 152 interposed between the condenser and the evaporator. The compressor is adapted to compress a suitable refrigerant such as Freon R-12, R-11 or R-22, heating the refrigerant and the air stream. The refrigerant is then discharged through thermostatic expansion valve 152, or a capillary tube, thence passing into the evaporator 151 where it extracts heat from the air stream for recirculation through the drum 129. Such heat extraction at the evaporator also serves to condense and remove entrained moisture from the air stream. The condensed moisture is discharged from the air duct via a drain 154 into a sump 155 from which it may be pumped to a sink or conducted to a floor drain. The refrigerant returns from the evaporator to the suction side of the compressor 149 and repeats the cycle.

In order to prevent lint from accumulating in the air duct system and impairing efficient heat transfer in the condenser and evaporator, a lint screen 156 is interposed in the air duct on the downstream side of the drum outlet 146 (FIGS. 12–16). The lint screen 156 may be slidably mounted in a narrow chute 158 extending from the top panel 118 down past the outlet 146. At its upper end, the screen 156 may be equipped with a collapsible handle 159 accessible from hinged cap 160 on the top panel to facilitate removal of the screen 156 for cleaning or replacement.

The air duct means 144 may be constructed in various ways, the objective being to achieve closed cycle, or substantially closed cycle, circulation of the drying air stream through the tumbling drum and over the evaporator, compressor and condenser. In the embodiment shown in FIGS. 12–15, the air duct means comprises the enclosures around the evaporator 151, the blower 148, and the condenser 150 which are connected by an enclosure 161 around the compressor 149. This arrangement permits the elimination of a back panel on the dryer cabinet 111, leaving the units 148, 150 and 151 readily accessible for servicing. As an alternative, however, a back panel may be included at the rear of the cabinet 111, closing the heat pump compartment 128. In such event, the compartment 128 serves as the connection between the enclosures of the evaporator 151 and the condenser 150, with the compressor 149 interposed in the air stream therebetween.

Turning next to FIG. 16, the structure of the condenser 150 and the evaporator 151 is there shown more specifically. In this instance, both the condenser 150 and the evaporator 151 constitute heat exchangers formed by nested coils of copper or aluminum tubing 162 extending through a stack of spaced apart metallic plates or fins 164. For ready access, the condenser enclosure is provided with a removable access cover 165 and the evaporator enclosure has a removable access cover 166. As an alternative, either or both of these heat exchangers may be fabricated of embossed metal plates known as "rollbon".

The refrigerant flow in the dryer 110, as in the case of the dryer 10, is metered so as to stabilize a condenser coil temperature of about 155 degrees F. and a pressure of about 250 psi on the high side of the expansion valve 152. By metering the air flow across the condenser coils, as well as the refrigerant flow in the heat pump system 142, the maximum temperature of the drying air may be stabilized at approximately 145 degrees F., eliminating the need for air temperature regulating thermostats.

The exemplary electrical circuit shown in FIG. 11 and described in connection with the dryer 10 is also adapted to operate the dryer 110 from a conventional 110 volt AC household power supply. The timed cycle and automatic cycle illustrated in FIGS. 11A and 11B and described earlier herein are also applicable to the operation of the dryer 110.

The compressor 149 is protected against frostback by the safety thermostat 89. When the thermostat 89 is actuated due to a temperature drop below −5 degrees F., its contacts 90 open and the trouble light 122 becomes energized to apprise the user of that condition. Power to relay R is thereupon interrupted causing relay contacts R-1 to open, thus de-energizing the compressor motor and stopping the compressor until the emergency condition has been remedied. When the push-button 125 is depressed, the thermostat switch 89 recloses, de-energizing the trouble light 122 and applying power to the time delay relay R. After approximately three minutes, the relay R becomes energized and closes contacts R-1 to restart the compressor motor.

Referring now to FIGS. 17–22, an illustrative clothes dryer 210 is there shown also embodying certain aspects of the invention. The dryer 210 comprises a cabinet 211 generally similar to that of the dryer 110 in that it incorporates a heat pump system 212 in a heat pump compartment 214 at the rear of the drum compartment 215. The heat pump compartment houses the compressor 216, condenser 217, expansion valve 218, evaporator 219, and blower 220, the latter being powered by drive motor 221 which also powers the tumbling drum 222. The exemplary electrical circuit shown in FIG. 11 is adapted to control the operation of the dryer 210.

In the present instance, both the condenser 218 and evaporator 219 are mounted on the transverse partition 224 in registry with inlet opening 225 and outlet opening 226, respectively, communicating directly with the interior of the drum 222. The cross sectional area of the condenser 217 and the drum inlet opening 225 is substantially larger than the cross sectional area of the evaporator 219 and its associated drum outlet opening 226.

As shown in FIGS. 17–20, air from the discharge of blower 220 is directed to the condenser 217 by an enclosed duct 228 situated within the heat pump compartment. An air flow diffuser 229 is mounted horizontally on the rear wall of the duct. The diffuser comprises a perforated flange 230 generally normal to the rear wall of the duct, and a non-perforated flange 231 and inclined upwardly relative to the duct wall. The diffuser 229 tends to even out the air flow across the condenser and into the drum.

Warm moist air is exhausted from the drum 222 through the evaporator 219 which communicates with the heat pump compartment around the duct 228. The air then passes around the compressor 216 and enters the intake of the blower 220 to repeat its cycle. Moisture condensed at the evaporator 219 is collected in a trough 232 and passes through drain line 234 to sump 235. From there, it is channelled to a floor drain or pumped to a sink.

Figure 21:
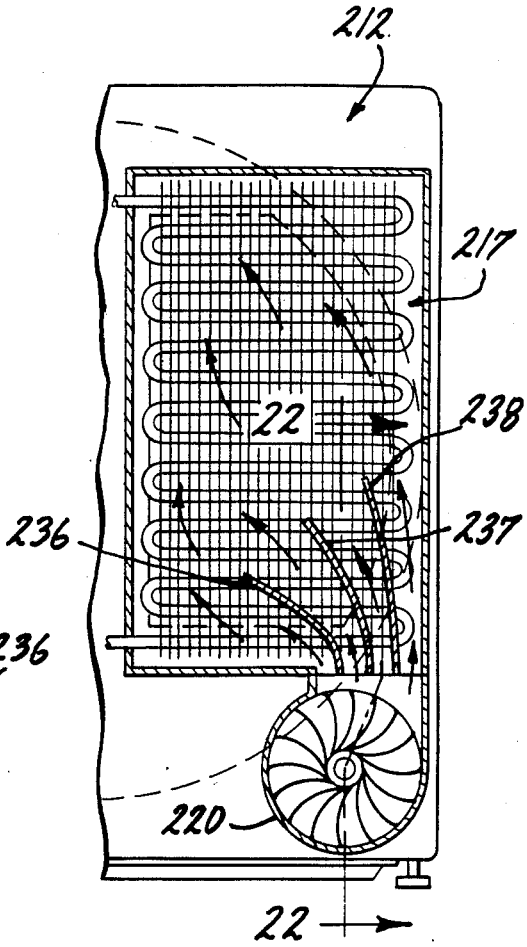
FIG. 21 is a fragmentary vertical sectional view taken through the air duct and distribution baffle means associated with the condenser.
Figure 22:
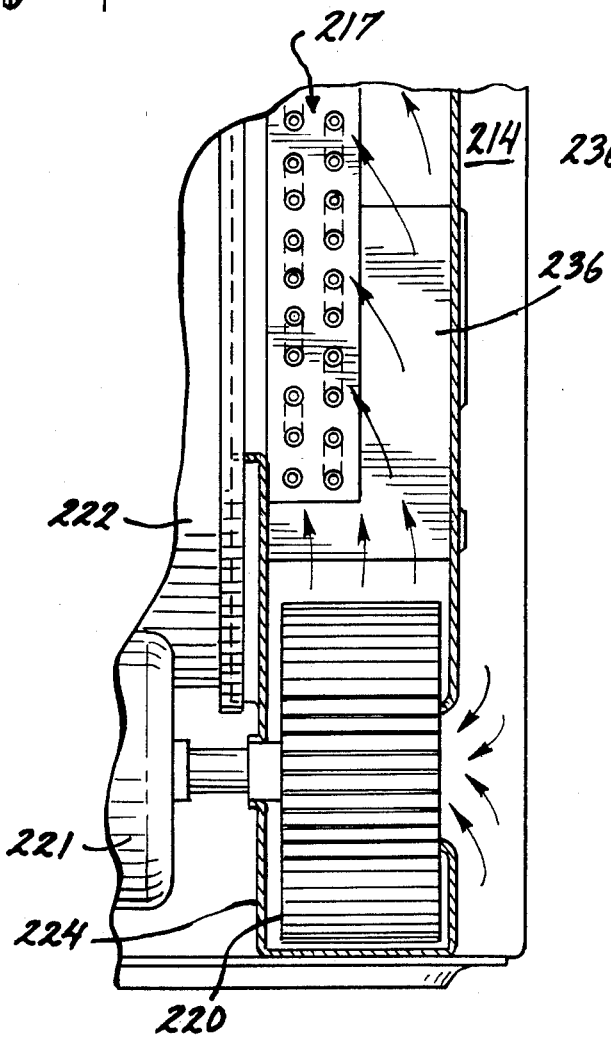
FIG. 22 is a fragmentary vertical sectional view taken in the plane of the line 22—22 in FIG. 21.

Referring next to FIGS. 21 and 22, a modified air diffuser arrangement is shown in the air supply duct 228 for the condenser. In this case a plurality of arcuate diffuser plates 236, 237, 238 are situated transversely of the air duct 228 commencing at the blower discharge. The diffuser plates divide the air flow and spread it evenly across the condenser 217.

It will be appreciated from all the foregoing that a clothes dryer constructed in accordance with the present invention will operate with a high degree of efficiency. In the case of one prototype of such a dryer, operated from a 110 volt AC household power supply, on a timed cycle of approximately 30 minutes with damp clothes just removed from the washing machine, the power consumption of the prototype dryer throughout the drying cycle measured approximately 1000 Watts. This contrasts markedly with the 4500 to 5500 Watt power consumption of a conventional electrical resistor heated clothes dryer operated from a 220 Volt AC power supply.

What is claimed is:

1. A heat pump dryer appliance for clothes and other washable products comprising, in combination:

(a) a cabinet having a drum compartment with opposed front and rear walls and an auxiliary compartment having a front wall in common with said rear wall of said drum compartment;

(b) a power driven rotatable tumbling drum housed in said drum compartment and having front and rear ends;

(c) combined bearing and air seal means for rotatably supporting said drum on a fixed rotational axis within said drum compartment;

(d) said bearing and air seal means including a first pair of annular members fixed respectively to said front and rear walls of said drum compartment, and a second pair of annular members disposed in sliding engagement with said first pair and fixed to respective ends of said drum;

(e) said annular members being formed from rigid non-metallic plastic material;

(f) each said annular member of one said pair defining a track and each said annular member of the other said pair defining a slider interfitting with said track;

(g) a resilient sealing gasket interposed between each said slider and said track;

(h) each said annular slider having a wedge shaped bead overlying its associated track inside said drum and tapering axially in thickness toward the rotational axis of said drum;

(i) a heat pump system in said cabinet including a compressor, condenser, expansion valve and evaporator defining a closed refrigerant circuit;

(j) means for circulating a stream of heated drying air in a substantially closed path through said condenser, said tumbling drum, said evaporator, said rear wall of said drum compartment, and across said compressor; and (k) said evaporator being formed as an air duct underlying said tumbling drum and defining a section of said substantially closed path running through said drum compartment.

2. A heat pump clothes dryer appliance comprising, in combination:

(a) a cabinet having a drum compartment;

(b) a power driven rotatable tumbling drum housed in said drum compartment;

(c) combined bearing and air seal means for rotatably supporting said drum on a fixed rotational axis within said drum compartment;

(d) said bearing and air seal means including at least one annular track of generally U-shaped cross section fixed relative to said drum compartment and one annular slider rotatably supported by said track and fixed to said drum;

(e) said slider interfitting closely in said track and including a sealing bead overlapping said track on the inside of said drum;

(f) a heat pump system in said cabinet including a compressor, condenser, expansion valve and evaporator defining a closed refrigerant circuit;

(g) means for circulating a stream of heated drying air in a substantially closed path through said condenser, said tumbling drum, said evaporator and across said compressor;

(h) said evaporator being formed as an air duct defining a section of said substantially closed path.

3. A heat recirculating clothes dryer appliance comprising, in combination:

(a) a cabinet having a front panel with an access opening therein;

(b) a transverse partition within said cabinet dividing the interior thereof into a drum compartment and an auxiliary compartment;

(c) a rotatable tumbling drum housed in said drum compartment and having an open rearward end portion disposed adjacent said transverse partition;

(d) a first combined bearing and air seal means interposed between said rearward end portion of said drum and said transverse partition, said first bearing and air seal means being mounted on said transverse partition and adapted to rotatably support said rearward end portion of said drum on a fixed rotational axis;

(e) a second combined bearing and air seal means mounted on said front panel in surrounding relation with said access opening and adapted to rotatably support said forward end portion of said drum on said fixed rotational axis said second bearing and air seal means being of substantially smaller diameter than said first bearing and air seal means;

(f) a heat pump system in said cabinet including a compressor, condenser, expansion valve, and evaporator defining a closed refrigeration circuit;

(g) means for circulating a stream of heated drying air in a substantially closed path through said heat pump system, said transverse partition and said drum;

(h) said evaporator being formed as an air duct in said drum compartment and comprising a portion of said substantially closed path.

4. A heat recirculating clothes dryer appliance comprising, in combination:

(a) a cabinet having a front panel with an access opening therein;

(b) a transverse partition within said cabinet dividing the interior thereof into a drum compartment and an auxiliary compartment;

(c) a rotatable tumbling drum housed in said drum compartment and having an open rearward end portion disposed adjacent said transverse partition;

(d) a first combined bearing and air seal means interposed between said transverse partition, said first bearing and air seal means being mounted on said transverse partition and adapted to rotatably support said rearward end portion of said drum on a fixed rotational axis;

(e) a second combined bearing and air seal means mounted on said front panel in surrounding relation with said access opening and adapted to rotatably support said forward end portion of said drum on said fixed rotational axis;

(f) each said bearing and air seal means comprising a fixed annular track of generally U-shaped cross section, an annular slider fixed to one end portion of said drum interfitting with said track, and said track and slider being fashioned from rigid nonmetallic material known as NYLON plastic;

(g) each said slider having a sealing bead portion overlapping said track on the inside of said drum;

(h) a heat pump system in said cabinet including a compressor, condenser, expansion valve, and evaporator defining a closed refrigeration circuit;

(i) means for circulating a stream of heated drying air in a substantially closed path through said heat pump system, said transverse partition and said drum;

(j) said evaporator being formed as an air duct in said drum compartment and comprising a portion of said substantially closed path.

5. A heat pump dryer appliance for clothes and other washables comprising, in combination:

(a) a cabinet having a drum compartment;

(b) a power driven rotatable tumbling drum mounted in said drum compartment;

(c) a heat pump system in said cabinet including a compressor, condenser, expansion valve, and evaporator defining a closed refrigerant circuit;

(d) said compressor, condenser and expansion valve being mounted outside said drum compartment;

(e) said evaporator being mounted within said drum compartment and having the configuration of an air duct surrounded by a refrigerant passage; and (f) means for circulating a stream of heated drying air in a substantially closed path through said condenser, the interior of said tumbling drum, said evaporator and across said compressor.

6. A clothes dryer appliance as defined in claim 5, wherein the refrigeration passage surrounding said evaporator duct is convoluted, and said evaporator duct is in communication with said drum and said air circulating means.

7. A clothes dryer appliance as defined in claim 6, wherein said evaporator is formed from embossed metal known as rollbon.

8. A heat recirculating clothes dryer appliance comprising, in combination:

(a) a cabinet having a drum compartment and an auxiliary compartment;

(b) a power driven rotatable tumbling drum mounted in said drum compartment;

(c) said drum having an access opening at its forward end and having its reverse end in communication with said auxiliary compartment;

(d) a heat pump system in said cabinet including a compressor, condenser, expansion valve and evaporator defining a closed refrigerant circuit;

(e) said compressor and condenser being mounted in said auxiliary compartment;

(f) said evaporator being mounted in said drum compartment and having the configuration of an air duct surrounded by a convoluted refrigerant conduit;

(g) means connecting one end of said evaporator duct with said access opening in the forward end of said drum;

(h) means connecting the opposite end of said evaporator with said auxiliary compartment; and (i) means in said auxiliary compartment for circulating a stream of heated drying air in a substantially closed path over said heat pump system and through said tumbling drum.

9. A clothes drying appliance as set forth in claim 8, wherein said evaporator has a bottom wall inclined downwardly toward an underlying sump for receiving moisture condensate.

10. A clothes drying appliance as defined in claim 8, wherein said evaporator is disposed in underlying relation with said tumbling drum.

11. A clothes drying appliance as defined in claim 8, wherein a panel of insulation is interposed between said evaporator duct and said drum.

12. A clothes drying appliance as defined in claim 8, wherein said evaporator duct is formed with a series of baffles to facilitate heat transfer and condensation of entrained moisture from the air stream passing therethrough.

13. A heat pump drying appliance for clothes and other washables comprising the combination of:

(a) a cabinet having a front panel with an access door therein;

(b) a transverse partition within said cabinet dividing the interior thereof into a drum compartment and an auxiliary compartment;

(c) a power driven tumbling drum rotatably supported within said cabinet having an access opening at its front end and having an open rearward end adjacent said transverse partition;

(d) a heat pump system in said cabinet including a compressor, condenser, expansion valve and evaporator defining a closed refrigerant circuit;

(e) said evaporator being mounted in said drum compartment and having the configuration of an air duct;

(f) means defining an air passage communicating between said condenser and the interior of said drum;

(g) a lint screen detachably mounted in said access door;

(h) means defining an air passage in said access door communicating with the interior of said drum via said lint screen and said access opening;

(i) means defining an air passage in said front panel communicating with said evaporator; and (j) means for circulating a stream of heated drying air in a substantially closed path through said condenser, said tumbling drum, said lint screen, said air passages in said access door and in front panel, said evaporator, said transverse partition, and across said compressor.

14. A heat pump dryer appliance for clothes and other washables as defined in claim 13, wherein said access door includes a sensing device operable to cut off power to said dryer in event said lint screen becomes clogged.

15. A heat pump dryer appliance as defined in claim 13, which further comprises:

(a) a sensing device in said access door adapted to detect a clogged lint screen and thereupon generate an electrical signal;

(b) a relay connected to said sensing device and operable in response to a clog signal from same;

(c) said relay having contacts in the dryer power circuit adapted to open upon actuation of said relay.

16. A heat recirculating clothes dryer appliance comprising the combination of:

(a) a cabinet;

(b) a transverse partition within said cabinet dividing the interior thereof into a drum compartment and a heat pump compartment;

(c) a power driven tumbling drum rotatably mounted in said drum compartment and having an open rearward end portion;

(d) a heat pump system including a compressor, condenser, expansion valve and evaporator defining a closed refrigerant circuit which, except for said evaporator, is mounted in said heat pump compartment;

(e) said evaporator being mounted in said drum compartment and having the configuration of an air duct; and (f) means for circulating a stream of heated drying air in a substantially closed path across said condenser, through the interior of said tumbling drum via the open rearward end portion thereof, through said evaporator and said compressor.

17. A heat pump dryer appliance as set forth in claim 16, wherein said combination forther comprises:

(a) an air circulating blower;

(b) an air duct interposed between said blower and said condenser; and (c) air diffuser means situated in said duct between said blower and said condenser adapted to spread the air stream evenly over said condenser.

18. A heat pump dryer appliance as set forth in claim 17, wherein said air diffuser means comprises at least two vanes disposed transversely of said air duct, said vanes being oriented in non-parallel relation with each other and with the air stream.

19. A heat recirculating clothes dryer appliance comprising the combination of:

(a) a cabinet;

(b) a transverse partition within said cabinet dividing the interior thereof into a drum compartment and a heat pump compartment;

(c) a power driven tumbling drum rotatably mounted in said drum compartment and having an open rearward end portion;

(d) a heat pump system including a compressor, condenser, expansion valve and evaporator defining a closed refrigerant circuit which, except for said evaporator, is mounted in said heat pump compartment;

(e) said evaporator being mounted in said drum compartment and having the configuration of an air duct;

(f) means for circulating a stream of heated drying air in a substantially closed path across said condenser, through the interior of said tumbling drum via the open rearward end portion thereof, through said evaporator and said compressor; and (g) wherein the maximum temperature of the heated drying air is regulated without thermostats or auxiliary heating or cooling means, by metering the flow of refrigerant through said expansion valve and by metering the flow of drying air across said condenser.

20. A heat recirculating clothes dryer appliance comprising the combination of:

(a) a cabinet;

(b) a transverse partition within said cabinet dividing the interior thereof into a drum compartment and a heat pump compartment;

(c) a power driven tumbling drum rotatably mounted in said drum compartment and having an open rearward end portion;

(d) a heat pump system including a compressor, condenser, expansion valve and evaporator defining a closed refrigerant circuit which, except for said evaporator, is mounted in said heat pump compartment;

(e) said evaporator being mounted in said drum compartment and having the configuration of an air duct;

(f) means for circulating a stream of heated drying air in a substantially closed path across said condenser, through the interior of said tumbling drum via the open rearward end portion thereof, through said evaporator and said compressor;

(g) a power supply circuit for said dryer;

(h) a compressor motor;

(i) a relay having contacts in series with the circuit (j) a safety thermostat connected to sense the temperature of the refrigerant at said evaporator; and (k) said safety thermostat having a set of contacts in series with said compressor motor relay, said safety thermostat being adapted to de-energize said relay and said compressor motor in the event entry of liquid refrigerant from the low pressure side of said expansion valve into the suction side of the compressor should be imminent.

* * * * *